US011547167B2

(12) United States Patent
O'Connell

(10) Patent No.: US 11,547,167 B2
(45) Date of Patent: Jan. 10, 2023

(54) PROTECTION ATTACHMENT FOR A HELMET

(71) Applicant: Gentex Corporation, Simpson, PA (US)

(72) Inventor: Jason W. O'Connell, Raynham, MA (US)

(73) Assignee: GENTEX CORPORATION, Simpson, PA (US)

( * ) Notice: Subject to any disclaimer, the term of this patent is extended or adjusted under 35 U.S.C. 154(b) by 138 days.

(21) Appl. No.: 17/053,593

(22) PCT Filed: May 16, 2019

(86) PCT No.: PCT/US2019/032682
§ 371 (c)(1),
(2) Date: Nov. 6, 2020

(87) PCT Pub. No.: WO2019/222510
PCT Pub. Date: Nov. 21, 2019

(65) Prior Publication Data

US 2021/0244122 A1 Aug. 12, 2021

Related U.S. Application Data

(60) Provisional application No. 62/672,093, filed on May 16, 2018.

(51) Int. Cl.
*A42B 3/04* (2006.01)

(52) U.S. Cl.
CPC ..... *A42B 3/0406* (2013.01)

(58) Field of Classification Search
CPC ..... A42B 3/0406; A42B 3/324; A42B 3/003; A42B 3/04
USPC ..... 2/422
See application file for complete search history.

(56) References Cited

U.S. PATENT DOCUMENTS 4,023,209 A 5/1977 Frieder, Jr.
5,271,103 A * 12/1993 Darnell ..... A42B 3/125 2/418
6,389,607 B1 5/2002 Wood
6,625,820 B1 9/2003 Lampe
6,701,649 B1 * 3/2004 Brosi ..... G09F 21/02 40/329

(Continued)

FOREIGN PATENT DOCUMENTS

WO 2015030703 A1 3/2015
WO 2017062945 A1 4/2017

OTHER PUBLICATIONS

Extended Search Report for corresponding European Application No. 19804413.3 dated Apr. 4, 2022, 7 pages.

(Continued)

*Primary Examiner* — Timothy K Trieu
(74) *Attorney, Agent, or Firm* — Morgan, Lewis & Bockius LLP

(57) ABSTRACT

A helmet attachment may include a body, a connector, and a fastener. The body may have a rim and a concave inner surface configured to engage convex outer surface of a helmet. The connector may be coupled to the inner surface of the body and the connector may be configured to engage a helmet connector. The fastener may extend from the rim and be configured to engage an element coupled to the helmet.

21 Claims, 10 Drawing Sheets

(56) References Cited

U.S. PATENT DOCUMENTS

| | | | | |
|---|---|---|---|---|
| D535,059 | S | 1/2007 | Lam | |
| 7,765,621 | B2 | 8/2010 | Lardeau | |
| D673,329 | S | 12/2012 | Batsch | |
| D677,006 | S | 2/2013 | Pfanner et al. | |
| D683,905 | S | 6/2013 | Wills | |
| 8,640,267 | B1 | 2/2014 | Cohen | |
| D701,348 | S | 3/2014 | Thurgood et al. | |
| D708,394 | S | 7/2014 | Mehra et al. | |
| 8,908,389 | B2 | 12/2014 | Teetzel et al. | |
| D733,972 | S | 7/2015 | Szalkowski et al. | |
| D744,170 | S | 11/2015 | Eastwood et al. | |
| 9,222,758 | B2 | 12/2015 | Strum | |
| D750,847 | S | 3/2016 | Noordzij et al. | |
| D752,814 | S | 3/2016 | Chilson et al. | |
| D754,930 | S | 4/2016 | Vito et al. | |
| 9,439,470 | B2 | 9/2016 | McGinn et al. | |
| 9,494,388 | B2 | 11/2016 | Crye et al. | |
| D776,357 | S | 1/2017 | Marting et al. | |
| 9,557,144 | B2 | 1/2017 | Strum | |
| D779,126 | S | 2/2017 | Uhm | |
| 9,693,595 | B2 | 7/2017 | Lebel et al. | |
| 9,788,587 | B2 | 10/2017 | Auranen et al. | |
| D802,225 | S | 11/2017 | Newman et al. | |
| D806,322 | S | 12/2017 | Noordzij et al. | |
| D830,644 | S | 10/2018 | Noordzij et al. | |
| D840,111 | S | 2/2019 | Noordzij et al. | |
| D854,750 | S | 7/2019 | O'Connell | |
| D856,598 | S | 8/2019 | Hancock | |
| D869,776 | S | 12/2019 | Noordzij et al. | |
| 10,638,807 | B2 | 5/2020 | Long et al. | |
| 2006/0282939 | A1 | 12/2006 | Rogers et al. | |
| 2012/0011631 | A1* | 1/2012 | Crossman | A42B 3/32 2/2.5 |
| 2012/0317706 | A1 | 12/2012 | Lebel et al. | |
| 2013/0000002 | A1 | 1/2013 | Crossman | |
| 2014/0123360 | A1 | 5/2014 | Cohen | |
| 2017/0295882 | A1 | 10/2017 | Walsh et al. | |
| 2017/0322481 | A1* | 11/2017 | Koch | G03B 17/561 |
| 2018/0092424 | A1 | 4/2018 | Hall et al. | |
| 2018/0279711 | A1 | 10/2018 | Szalkowski et al. | |
| 2018/0292178 | A1 | 10/2018 | Gehring et al. | |
| 2018/0335282 | A1 | 11/2018 | Ganor | |
| 2018/0360151 | A1 | 12/2018 | Desjardins | |
| 2019/0101359 | A1 | 4/2019 | Zimmer | |

OTHER PUBLICATIONS

International Search Report and Written Opinion dated Aug. 20, 2019 for International Patent Application No. PCT/US2019/032682, 10 pages.

https://www.velsyst.com/762x39-msc-slaap.html; Velocity Systems webpage for SLAAP helmet, downloaded Oct. 11, 2016.

MDM-Gentex Ballistic Applique—Soldier Systems Daily (on-line), dated Oct. 1, 2016. Retrieved from Internet Sep. 12, 2020, URL: https: /web/archive.org/web/20161001034538/https://soldiersystems.net/2016/09/27 /mdm-gentrex-ballistic-applique/ (1 page) (Year: 2016 ).

Extending Personal Protection—Armada International (on-line), dated Apr. 14, 2020. Retrieved from Internet Sep. 12, 2020, URL: https:// armadaintemational .com/2020/04/extending-personal-protection/ (3 pages) (Year: 2020).

AU SA—Family of Tactical Head borne Systems from Revision Military (on-line), dated Oct. 7, 2016. Retrieved from Internet Sep. 12, 2020, URL: https://web.archive.org/web/20161007165508/https://soldiersystems.net/2016/10/04/ ausa-family-of-tactical-headborne-systems-from-revision-military/ (3 pages) (Year: 2016).

Ballistic Helmet Up—Armor and Applique (on-line), dated Mar. 9, 2018. Retrieved from Internet Sep. 12, 2020, URL: https://www.hardheadveterans.com/blogs/reviews/ballistic-helmet-up-armor-and-applique (3 pages) (Year: 2018).

Revision Caiman Ballistic Applique-Body Armor Outlet (on-line), no date available. Retrieved from Internet Sep. 12, 2020, URL: https:// www .bodyarmoroutlet.com/products/caiman-ballistic-applique (2 pages).

* cited by examiner

PROTECTION ATTACHMENT FOR A HELMET

CROSS REFERENCE TO RELATED APPLICATIONS

This application is a U.S. National Phase of International Application No. PCT/US2019/032682 filed on May 16, 2019, which claims the benefit of U.S. Provisional Patent Application No. 62/672,093 filed May 16, 2018 entitled "Protection Attachment for a Helmet", each of which is incorporated by reference herein in its entirety.

BACKGROUND OF THE INVENTION

The present invention generally relates to a helmet attachment and, more particularly, to an attachment for increasing the impact and/or ballistic protection of a helmet system.

Existing helmets offer protection against ballistic and blunt force trauma but may not offer a level of protection desired in certain scenarios. Some existing helmets offer the desired protection but are heavy or bulky. That trade-off is not always desired which may reduce use of the helmet by the intended wearer. Thus, a need exists for a helmet system that is comfortable to wear and offers the enhanced protection when needed.

BRIEF SUMMARY OF THE INVENTION

In one embodiment there is a helmet attachment including a body, a connector, and a fastener. The body may have a rim and a concave inner surface configured to engage a convex outer surface of a helmet. The connector may be coupled to the inner surface of the body and the connector may be configured to engage a helmet connector. The fastener may extend from the rim and be configured to engage an element coupled to the helmet.

The helmet attachment may include a first portion and a second portion and each of the first portion and the second portion may be independently detachable from the helmet. The first portion may include a front portion and the second portion may include a rear portion. The first portion may be spaced from the second portion.

The body may include a cutout configured to receive a shroud coupled to the helmet. The cutout may have a spade shape. The helmet attachment may be generally rigid. The connector may include a plurality of connector patches and each of the plurality of connector patches may comprise one half of a hook and loop connector.

The fastener may be generally rigid. The fastener may include a sidewall having a catch configured to engage the element. The sidewall may be bendable to selectively disengage the catch from the element. The fastener may include a tab configured to be positioned adjacent the rim. The fastener may include a channel configured to receive a protrusion on the element.

The body may be configured to provide ballistic protection for the helmet. The body may comprise at least one of expanded polystyrene, expanded polypropylene, urethane foam, aromatic polyamide fiber, high density polyethylene, acrylonitrile butadiene styrene (ABS) plastic, nylon, standard injection molded polyethylene, and ceramic. The body may be configured to resist blunt force impacts.

The helmet attachment may be configured to reduce infrared visibility of the helmet system. An infrared visibility of an outer surface of the body may be generally constant throughout. The fastener may be configured to be positioned above an ear of the user when the helmet attachment is coupled to the helmet. The helmet attachment may include an opening and the fastener may include a shaft configured to be received by the opening. In a further embodiment, the helmet attachment includes the fastening element coupled to the outer surface of the helmet and the fastening element may be a mounting rail.

In another embodiment there is a helmet attachment comprising a body, a plurality of connector patches coupled to an inner surface of the body, and a substantially rigid fastener. The inner surface of the body may be may be a concave inner surface configured to engage a convex outer surface of a helmet. The body may be generally rigid and may include a rim. The plurality of connector patches may be coupled to the inner surface of the body. Each of the plurality of connector patches may comprise one half of a hook and loop connector configured to couple to a corresponding second half of a hook and loop connector coupled to the outer surface of the helmet. The substantially rigid fastener may extend from the rim and may be configured to engage a mounting rail coupled to the helmet.

In another embodiment there is a helmet system including a helmet having an outer surface, a mounting rail coupled to the helmet, and an impact protection attachment removably coupled to the helmet and at least partially extending over the outer surface of the helmet. The impact protection attachment may include a fastener configured to be coupled to the mounting rail. The mounting rail may include a receiver and the fastener may be configured to be received by the receiver. The fastener may include a sidewall having a catch configured to engage a portion of the receiver. The sidewall may be configured to be deflected to selectively disengage the catch from the portion of the receiver.

In a further embodiment, there is a spacer positioned between the helmet and the mounting rail. The fastener may be configured to be positioned between the spacer and the mounting rail. The fastener may include a tab configured to be positioned adjacent an upper surface of the mounting rail. The tab may be configured to extend radially outward less than the mounting rail. The tab may be configured to be positioned adjacent a lower surface of the impact protection attachment. The receiver may include a protrusion and the fastener may include a channel configured to receive the protrusion.

The impact protection attachment may be detachably coupled to the helmet. The impact protection attachment may be configured to provide ballistic protection for the helmet. The impact protection attachment may include at least one of expanded polystyrene, expanded polypropylene, urethane foam, aromatic polyamide fiber, and ceramic. The impact protection attachment may be configured to resist blunt force impacts. The impact protection attachment may include a first portion and a second portion and each of the first portion and the second portion are independently detachable from the helmet. The first portion may include a front portion and the second portion may include a rear portion. The first portion may include a left side portion and the second portion may include a right side portion. The impact protection attachment may be configured to reduce infrared visibility of the helmet system.

In a further embodiment, there is a connector between the helmet and the impact protection attachment. The impact protection attachment may include a cutout configured to receive a shroud coupled to the helmet. The cutout may include a spade shape.

BRIEF DESCRIPTION OF THE SEVERAL VIEWS OF THE DRAWINGS

The following detailed description of embodiments of the helmet attachment will be better understood when read in conjunction with the appended drawings of an exemplary embodiment. It should be understood, however, that the invention is not limited to the precise arrangements and instrumentalities shown. For example, although not expressly stated herein, features of one or more various disclosed embodiments may be incorporated into other of the disclosed embodiments.

In the drawings.

DETAILED DESCRIPTION OF THE EXEMPLARY EMBODIMENT OF THE INVENTION

Figure 1:
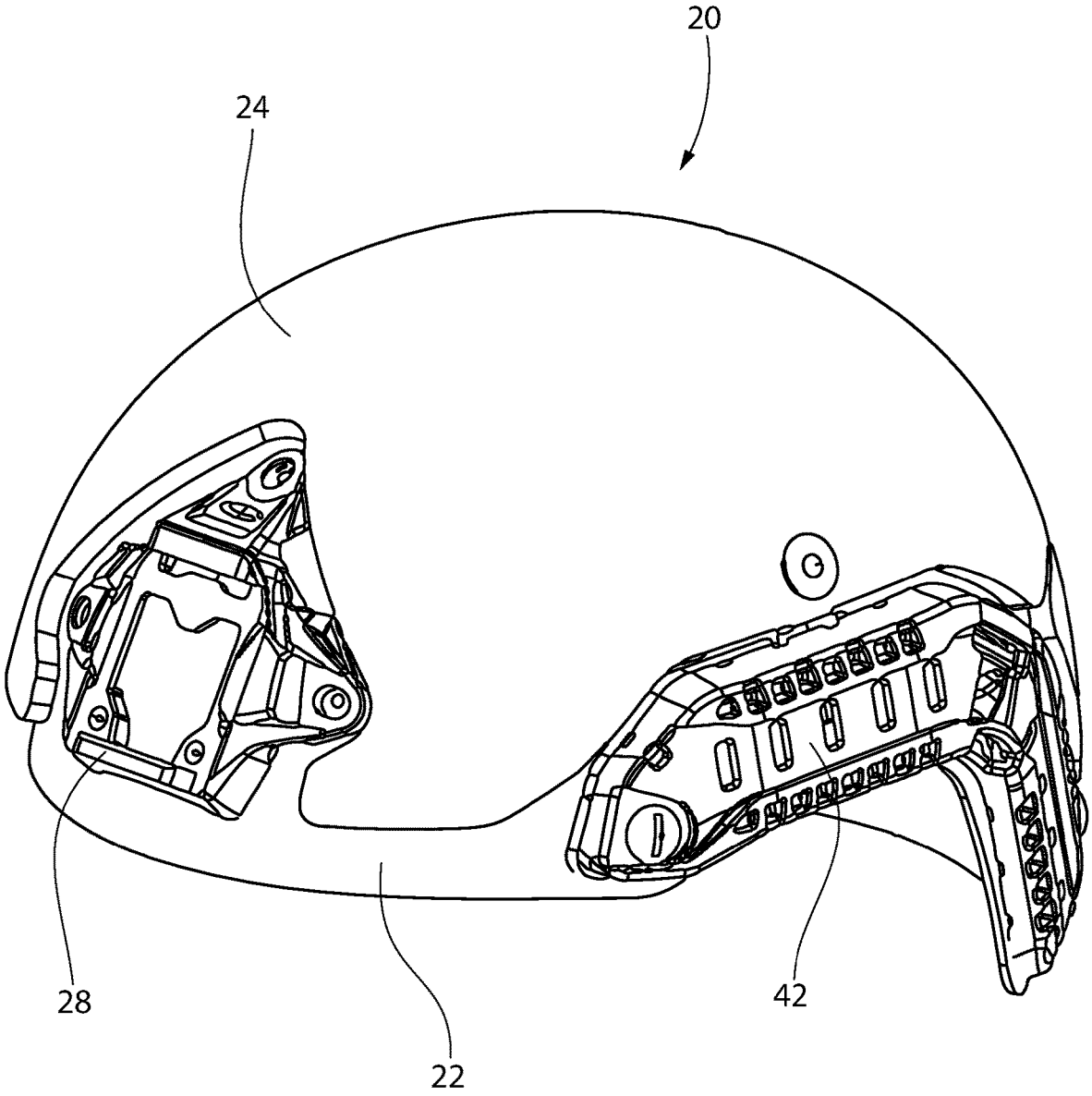
FIG. 1 is a front perspective view of a helmet attachment in accordance with an exemplary embodiment of the present invention shown attached to a helmet system.

Helmets for head protection are worn in a variety of environments and for various purposes including adventure, sporting, police and military purposes. Helmets generally include a helmet shell having a peripheral edge and a retention system (e.g., chinstrap) that may be attached to the helmet shell. Accessory devices may be added or attached to the helmet according to the needs of the wearer and the demands of the environment in which the helmet is to be used. Accessory devices may include, for example, night vision goggles, lights, face shields, headsets, cameras, eye protection goggles or visors, oxygen masks and other devices. The method of attaching accessories to the helmet may include attaching a mount to the helmet shell that is configured to couple with an accessory device. The accessory may be releasably coupled to the mount so that the accessory can be removed from the helmet when not in use. Helmets may provide protection against projectiles or blunt force impact. The level of protection may be related to the helmet material selected and the thickness of the helmet material. Generally, thicker helmet material provides greater protection against projectiles and blunt force impact than a thinner helmet material. Increased helmet thickness also increases the weight of the helmet which may decrease use of the helmet by a user. It is desirable to have a lighter helmet when the elevated level of protection provided by a thicker helmet is not required. A protective element that is removably attached to the helmet may increase the protection of the helmet when desired and also be removable when unnecessary.

The helmet system of the present invention may include a helmet with a mounting rail and a helmet attachment having an inner surface configured to couple to the helmet. The helmet attachment may include a fastener such as a clip configured to engage the mounting rail. The helmet attachment may include a connector such as one half of a hook and loop patch configured to engage a second half of a hook and loop connector coupled to the helmet. The helmet attachment may be quickly donned and doffed without the use of tools. In some embodiments, the helmet attachment may be donned with a single hand while wearing the helmet. In some embodiments, it may take two hands to remove the helmet attachment to release the hook and loop patches and the clip. In some embodiments, the clip includes a lock that need to be released to detach from the mounting rail. The helmet attachment may include a cutout configured to at least partially surround a shroud. The helmet attachment may comprise one or multiple pieces. The helmet attachment may comprise two or more pieces each independently couplable to the helmet. The helmet system may include a kit with different helmet attachments configured to reduce visibility (e.g., in daylight or infrared visibility), provide color variation, or provide camouflage adapted to a plurality of environments. The helmet attachment may be configured to defeat rifle rounds such as, for example, 7.62 millimeter rounds.

Referring to the drawings in detail, wherein like reference numerals indicate like elements throughout, there is shown in FIGS. 1-10 a helmet system, generally designated 20, in accordance with an exemplary embodiment of the present invention. The helmet system 20 may include a helmet 22 and a helmet attachment 24. The helmet 22 may be configured to be worn by a user. In certain embodiments, the helmet 22 is a standard infantry ballistic helmet, advanced combat helmet (ACH), or lightweight advanced combat helmet (LWACH). In other embodiments, helmet 22 may be a modular integrated communications helmet (MICH), a tactical ballistic helmet (TBH), a lightweight marine helmet, police general duty helmet, or a personnel armor system for ground troops (PASGT) helmet. The helmet attachment 24 may be provided to couple to the outer surface of the helmet 22 to increase the impact protection. In one embodiment, the helmet attachment 24 is comprised of ballistic grade materials to increase the ballistic protection of a ballistic helmet 22. In one embodiment, the helmet attachment 24 provides ballistic protection to a non-ballistic bump type helmet such as shown in the drawings. The helmet attachment 24 may be referred to as a helmet applique or a ballistic applique. The helmet attachment 24 may include an inner surface 26 configured to couple to the helmet 22. The inner surface 26 may be concave shaped or dimensioned to couple to a selected helmet 22. The inner surface 26 may have a radius of curvature of about 80 mm to about 200 mm. The contour of the inner surface 26 may match the contour of the outer surface of the helmet attachment 24. The helmet attachment 24 may be generally rigid. The helmet attachment 24 may have a predetermined concave shape configured to generally match the convex shape of a selected helmet.

The helmet attachment 24 may be configured to resist blunt force impacts. The helmet attachment 24 may resist blunt force impacts by reducing the energy imparted to a user's head when the helmet attachment 24 is impacted (e.g., by a blunt force). The size and/or stiffness of the helmet attachment 24 may be selected to spread the impact over a larger area than that of the impact instrument imparting the blunt force. In some embodiments, the helmet attachment 24 may be configured to at least partially deform when subjected to blunt force impact such that the helmet attachment 24 absorbs energy from the blunt force impact. The helmet system 20 including the helmet attachment 24 may be configured to meet standardized testing protocols (e.g., DoD, DOT, EN, or ANSI). The helmet attachment 24 may be configured to resist puncture or penetration. The helmet attachment 24 may be configured to resist cracking, splintering, or spalling. The helmet attachment 24 may be configured to resist multiple blunt force impacts to the same location on the helmet attachment 24.

The helmet attachment 24 may be configured to provide thermal protection. The helmet attachment 24 may be a thermal insulator. In one embodiment, heat is applied (e.g., 7 kW/m2 for 1 min) to the outside the helmet attachment 24 and the increase in temperature inside the helmet is less than a selected amount (e.g., less than or equal to 25 degrees Celsius). The helmet attachment 24 may help maintain the structural integrity of the helmet 22 such that the helmet does not disintegrate, fall apart, or drip after heat is applied to the exterior of the helmet 22 or helmet attachment 24.

The helmet attachment 24 may be flame resistant or nonflammable. In one embodiment, an external flame is applied to an exterior of the helmet attachment 24 such that the helmet attachment 24 is enflamed. The helmet attachment 24 may no longer be enflamed at a selected time period after the external flame is removed. The selected time period may be about 0 seconds, about 1 second, about 2 seconds, about 3 seconds, about 4 seconds, about 5 seconds, less than 5 seconds, less than 4 seconds, less than 3 seconds, less than 2 seconds, or less than 1 second.

The helmet attachment 24 may be configured to meet advanced combat helmet testing protocols (e.g., AR/PD 10-2). The helmet attachment 24 may be impacted at one or more select locations with a force less than a selected amount. In one embodiment, the helmet 22 with the helmet attachment 24 is mounted on a head form, and the helmet 22 with the head form therein is inverted and dropped onto an object (e.g., a stationary anvil) with a specific force. The helmet 22 may be completely inverted and dropped such that a portion of the helmet attachment 24 adjacent a crown of the helmet impacts the object. The helmet 22 may be rotated (e.g., 15 degrees beyond face up, with the chin higher than forehead) and dropped with a selected force such that a rear of the helmet attachment 24 (e.g., an upper half of the rear plate) impacts the object.

The helmet attachment 24 may transfer less than 150 G to the head form in the helmet 22 in response to a 10 foot per second (ft/s) drop on an anvil when measured at a selected location (e.g., on the crown, forehead, sides, rear, or nape). The helmet attachment 24 may transfer less than 150 G to the head form in the helmet 22 in response to a drop of 11 ft/s, 12 ft/s, 13 ft/s, 14 ft/s, 15 ft/s, 16 ft/s, 17 ft/s, 18 ft/s, 19 ft/s, 20 ft/s, 21 ft/s, 22 ft/s, 23 ft/s, 24 ft/s, 25 ft/s, less than 25 ft/s, less than 20 ft/s, or less than 15 ft/s on an anvil when measured at a selected location. The helmet attachment 24 may resist back face deformation (BFD) when subject to ballistic impacts. In some embodiments, the BFD is measured as the depth of a dent in the head form and is less than about 12 mm to about 24 mm. In some embodiments, the BFD is measured by calculating the volume of the dent in the head form and the volume is less than a selected amount.

The helmet system 20 including the helmet attachment 24 may be configured to meet the testing protocols for hard hats (e.g., ANSI Z89.1) or mountaineering/climbing helmets (EN-12492). The helmet attachment 24 may be configured to resist falling objects (e.g., a brick). The helmet system 20 may be coupled to a head form and an object (e.g., an anvil) may be dropped thereon and the helmet attachment 24 may limit the impact energy of the impact and resist penetration when the object is a pointed object.

Figure 10:
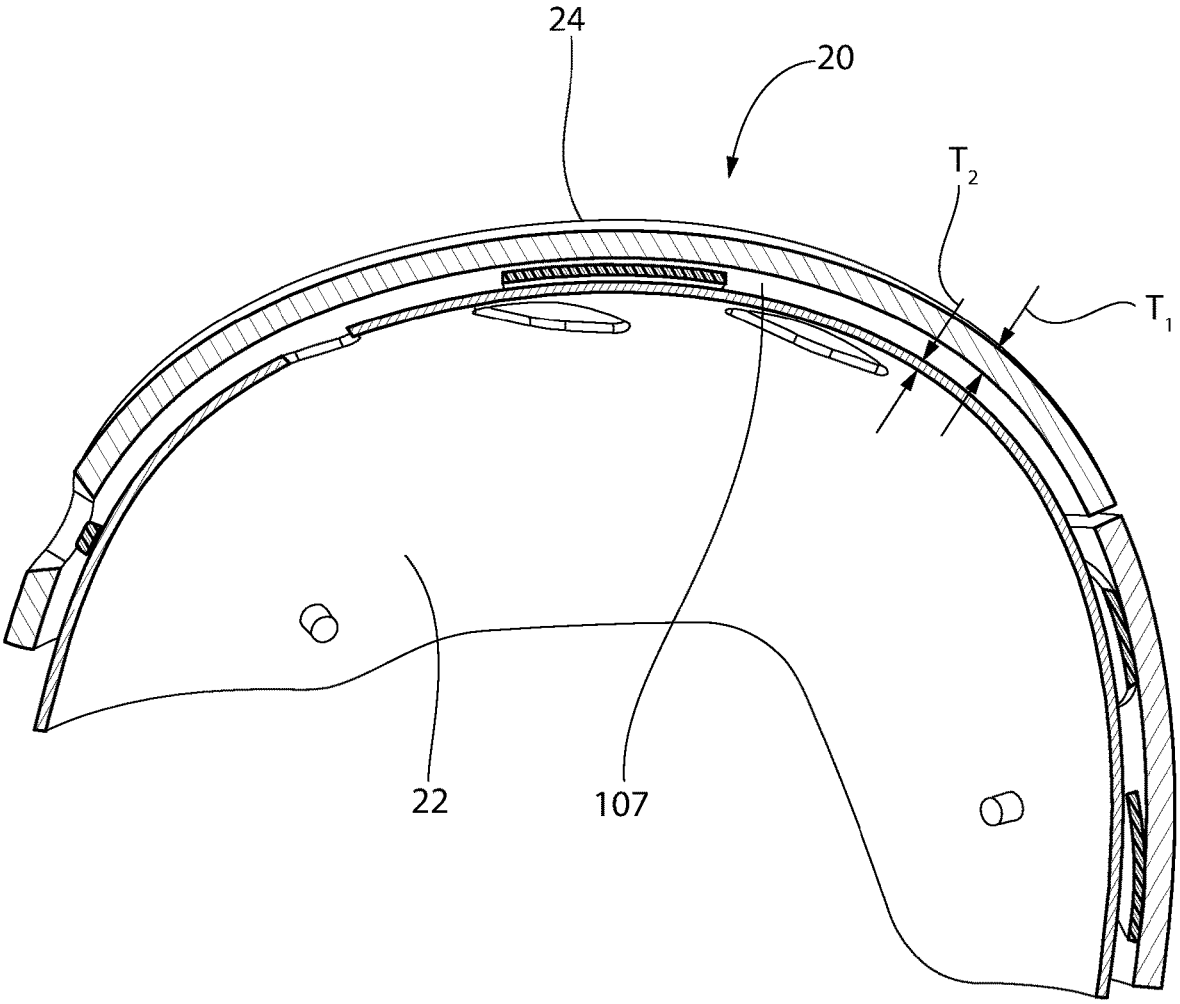
FIG. 10 is a left-side sectional view of the helmet system of FIG. 1.

Referring to FIG. 10, the helmet attachment 24 may have a helmet attachment thickness $T_1$ and the helmet 22 may have a helmet thickness $T_2$. In some embodiments, thickness $T_1$ is greater than thickness $T_2$. In other embodiments, thickness $T_1$ is less than thickness $T_2$. The material selected for the helmet attachment 24, or the helmet attachment thickness $T_1$, may be selected such that the helmet attachment provides ballistic protection to a user. Features of the helmet attachment 24 (e.g., material or thickness) may be selectively adopted to defeat a selected level of ballistic rounds. In some embodiments, the features of the helmet attachment 24 are selected such that the helmet attachment 24 slows down a ballistic projectile such that the projectile can be stopped by the helmet 22. The helmet attachment 24 may include a first layer (e.g., outer layer) and a second layer (e.g., inner layer) and the layers may comprise different materials. The first layer may have a thickness of about 0.002 inches to about 0.01 inches. The second layer may have a thickness of about 0.005 inches to about 0.15 inches. The helmet attachment 24 may have a thickness of about 0.007 inches, about 0.015 inches, about 0.1 inches, about 0.15 inches, about 0.2 inches, about 0.3 inches, about 0.4 inches, about 0.5 inches, less than about 1 inch, less than about 0.75 inches, or less than about 0.5 inches.

The helmet attachment 24 may be manufactured from a first material and the helmet 22 may be manufactured from a second material. In some embodiments, the first material is different from the second material. In other embodiments, the first material is the same as the second material. The helmet attachment 24 may be manufactured from at least one of expanded polystyrene, expanded polypropylene, urethane foam, aromatic polyamide fiber, ceramic, high density polyethylene, ABS plastic, nylon, and standard injection molded polyethylene. In one embodiment, the helmet attachment 24 is manufactured from high density polyethylene and is covered in a chemical agent resistant coating (CARC) such as, for example CARC paint MIL-DTL-641598B. The CARC paint may be at least one of matte, epoxy based, fire resistant, chemical resistant, and chemically inert. An outer surface of the helmet attachment 24 may be textured (e.g., smooth, grooved, or roughened).

The helmet attachment 24 may reduce the contrast between the helmet system 20 and the surrounding environment (e.g., when observed with an infrared device). Infrared reflection may be measured (e.g., using a photospectrometer) and the reflection wavelength, or reflectance, of the helmet system 20 may be within about 0.1 mm, about 0.01 mm, about 0.001 mm, about 0.0001 mm, or about 0.00001 mm of the reflection wavelength of the surrounding environment. The difference between the reflection wavelength of the outer surface of the helmet attachment 24 and the reflection wavelength of the outer surface of the helmet 22 may be at least about 0.1 mm, about 0.01 mm, about 0.001 mm, about 0.0001 mm, or about 0.00001 mm. The helmet attachment 24 may be configured to reduce the visual signature or near infrared (NIR) signature of the helmet system 20.

Figure 4:
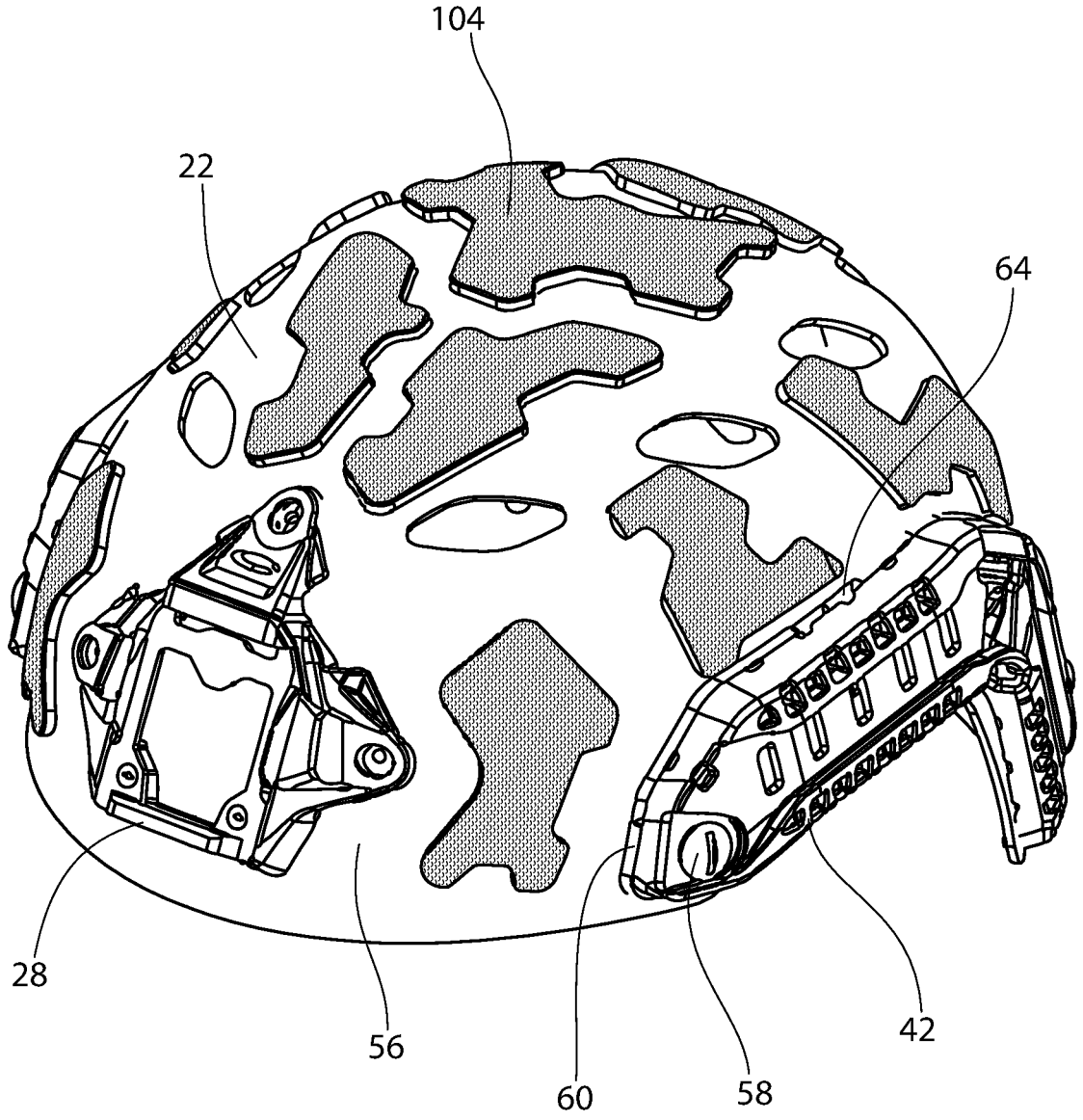
FIG. 4 is a front perspective view of the helmet system of FIG. 1 with the helmet attachment removed.

Referring to FIGS. 1 and 4, the helmet 22 may include a first connector 104 (e.g., hook and loop patches) that are visible to infrared detection systems. The helmet attachment 24 may cover the first connector 104 such that the helmet system 20 is nearly, or completely, invisible to infrared detection systems. The helmet attachment 24 may cover the hook and loop patches on the helmet 22. The outer surface of the helmet attachment 24 may be devoid of hook and loop patches. By covering the hook and loop patches on the helmet and having an outer surface devoid of hook and loop patches, the helmet attachment 24 may reduce the variance in reflectance of the helmet 22. In some embodiments, the helmet attachment 24 provides impact protection (e.g., ballistic and/or blunt force impact protection) and reduces infrared visibility. In other embodiments, the helmet attachment 24 reduces infrared visibility (e.g., reduces the contrast between the helmet attachment 24 and the surrounding environment when viewed with an infrared device) and is thinner than a helmet attachment that provides impact protection.

The reflectance of the outer surface of the helmet attachment 24 may be less than about 0.5 mm, about 0.4 mm, about 0.3 mm, about 0.2 mm, about 0.1 mm, about 0.01 mm, about 0.001 mm, about 0.0001 mm, or about 0.00001 mm. The reflectance of the outer surface of the helmet attachment 24 may be the same as the reflectance of the outer surface of the helmet 22 that does not include the connector. The helmet attachment 24 may reduce the variance in the change in reflectance across the outer surface of the helmet 22. The variance in the change in reflectance across the outer surface of the helmet 22 may be less than about 0.1 mm, about 0.01 mm, about 0.001 mm, about 0.0001 mm, or about 0.00001 mm when the helmet attachment 24 is coupled to the helmet 22.

Figure 2:
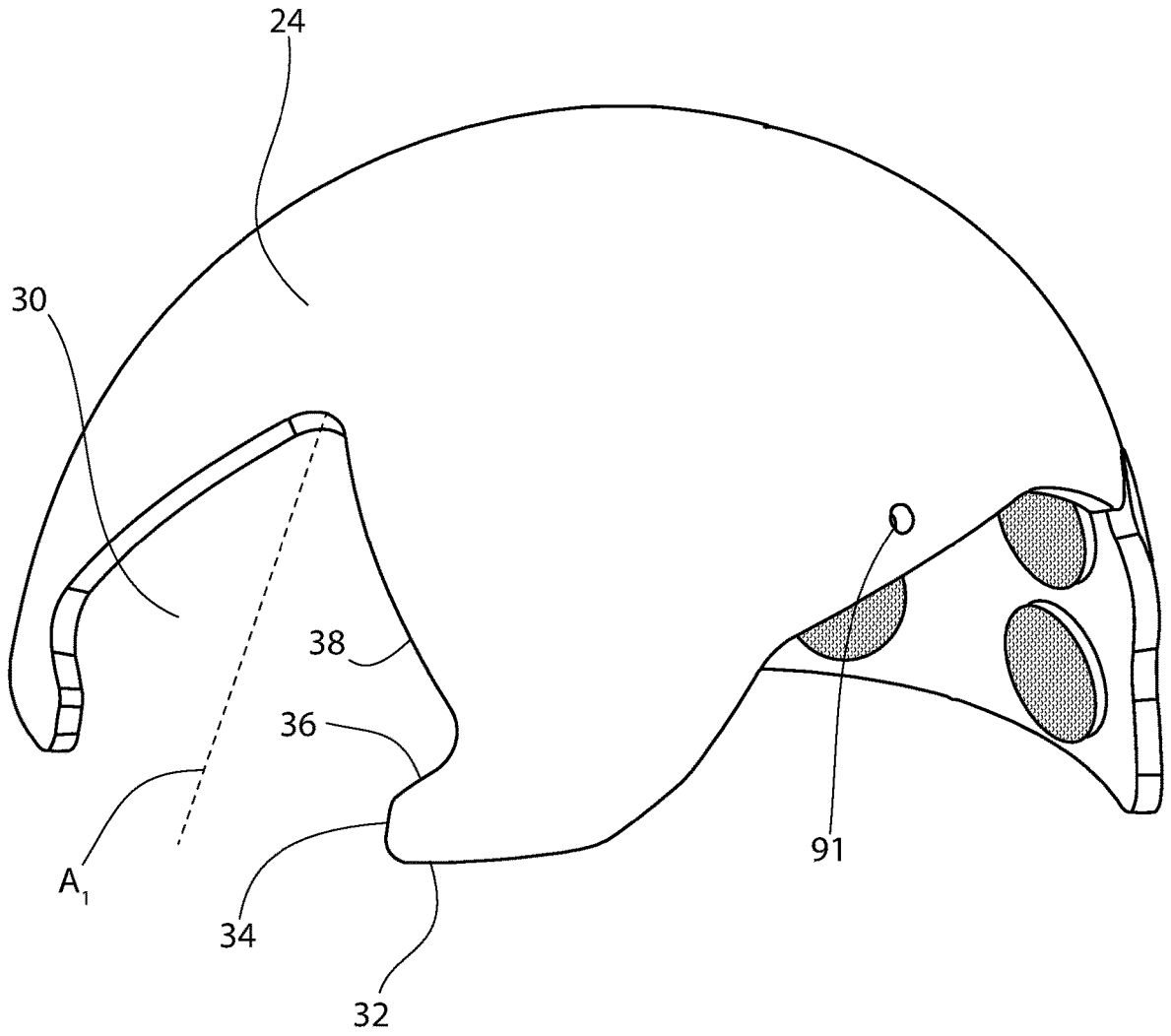
FIG. 2 is a front perspective view of the helmet attachment of FIG. 1.

Referring to FIG. 2, the helmet attachment 24 may include a cutout 30 configured to receive at least a portion of the shroud 28. The cutout 30 may be open ended or may be a closed cutout. In some embodiments, the cutout 30 includes a closed perimeter. In other embodiments, the cutout 30 includes an open perimeter. In some embodiments, the cutout 30 is configured to completely surround the shroud 28. In other embodiments, the cutout 30 is configured to encircle the shroud 28 or surround the shroud 28 in a selected plane. In some embodiments, the helmet attachment 24 does not include a cutout 30 and instead overlaps the shroud 28 and/or any attachment coupled to the shroud 28. The outer surface of the helmet attachment 24 may include a change in contour such that the helmet attachment 24 at least partially extends over the shroud 28. The helmet attachment 24 may include a shroud 28 instead of a cutout and couple to a helmet 22 that does not include a shroud. In some embodiments, the cutout 30 is positioned on the front of the helmet attachment 24. In other embodiments, the cutout 30 is positioned on a top, side, or rear of the helmet attachment 24. The cutout 30 may be shaped to receive a feature that is fixed to the helmet 22 (e.g., the shroud). The cutout 30 may be shaped to receive a feature that is detachably coupled to the helmet 22 (e.g., a battery pack coupled to the rear of the helmet).

With continued reference to FIG. 2, the shape or dimension of the cutout 30 may be selected to receive a selected shroud 28. In one embodiment, the cutout 30 has an upper portion that is triangular shaped and a tapered open bottom such that the bottom edges of the helmet attachment partially encircle the shroud 28. In one embodiment, the cutout 30 is spade shaped. The cutout 30 may include a first portion 34 adjacent a lower rim 32 of the helmet attachment 24. The first portion 34 may be transverse to the lower rim 32. The first portion 34 may be perpendicular to the lower rim 32. The cutout 30 may include a second portion 36. The second portion 36 may extend from an end of the first portion 34 away from axis $A_1$. The second portion 36 may be transverse to one or both of the first portion 34 and the lower rim 32. The second portion 36 may be parallel to the lower rim 32. In one embodiment, the second portion 36 is longer than the first portion 34. In other embodiments, the second portion 36 is shorter than the first portion 34.

Still referring to FIG. 2, the cutout 30 may include a third portion 38. The third portion 38 may extend from the end of the second portion 36 toward axis $A_1$. The third portion 38 may be transverse to one or more of the first portion 34, the second portion 36, and the lower rim 32. The third portion 38 may be parallel to the first portion 34. The third portion 38 may be longer than at least one of the first portion 34, the second portion 36, and the combined length of the first portion 34 and the second portion 36. The first portion 34 may have a length of about 0 inches to about 0.75 inches. The second portion 36 may have a length of about 0.125 inches to about 1 inch. The third portion 38 may have a length of about 2.5 inches to about 4 inches. The third may portion 38 extend from an end of the second portion 36 toward axis $A_1$. The cutout 30 may be symmetrical about axis $A_1$. The third portion 38 on a first side of the axis $A_1$ may be parallel to the second portion 36 on a second side of the axis $A_1$. The cutout 30 may have a surface area of about 1.5 square inches to about 2 square inches, about 2.5 square inches to about 5 square inches, about 5 square inches to about 15 square inches, about 7 square inches to about 13 square inches, about 9 square inches to about 11 square inches, or about 10 square inches.

Figure 3:
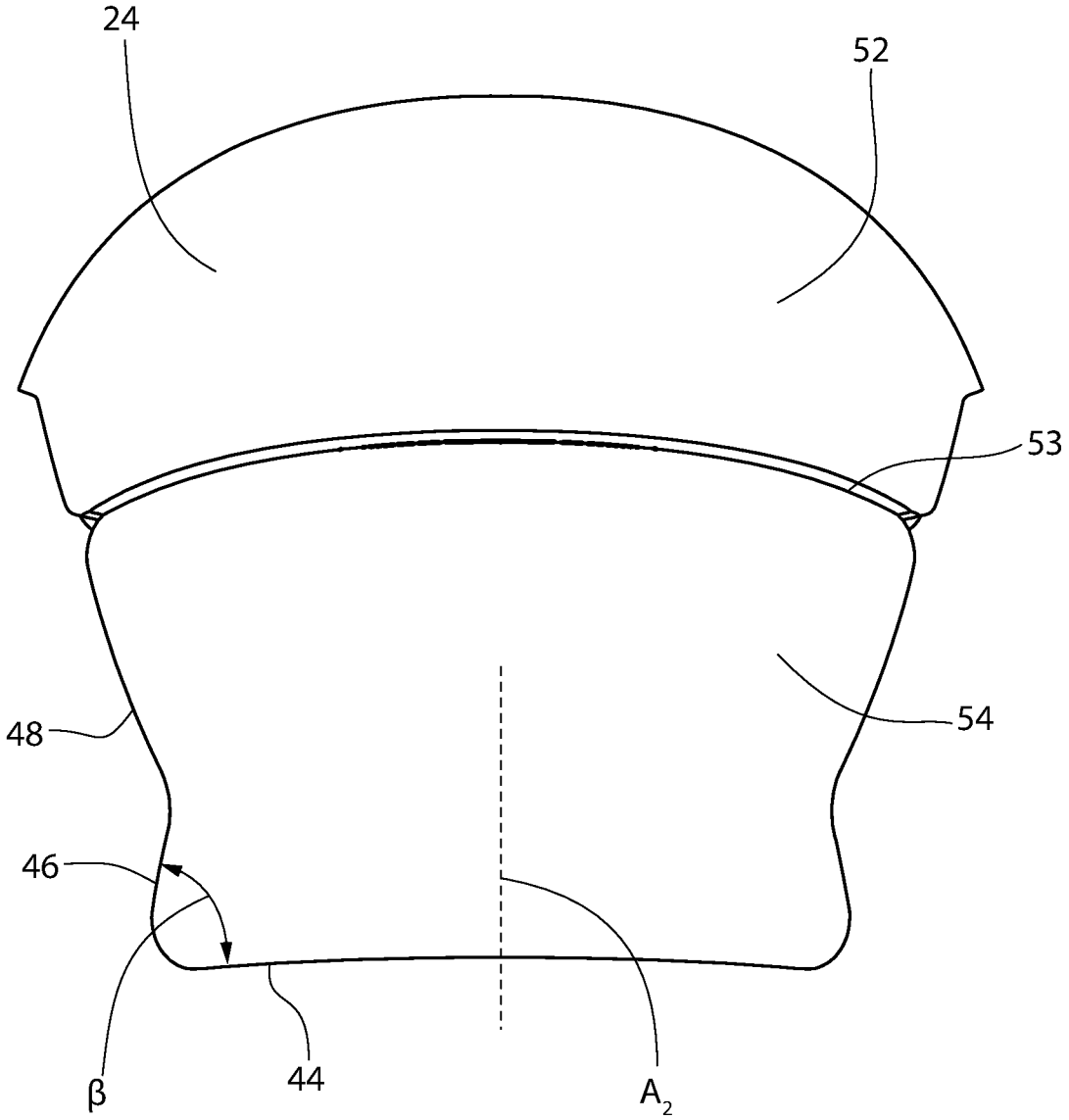
FIG. 3 is a rear elevational view of the helmet attachment of FIG. 1.

Referring to FIGS. 1 and 3, the helmet system 20 may include a mount such as a mounting rail 42 coupled to the helmet 22. One example of a mounting rail contemplated for use is described in U.S. Pat. No. 7,849,517, the disclosure of which is hereby incorporated by reference in its entirety herein. One type of mounting rail contemplated for use are Ops-Core Accessory Rail Connectors (ARC Rails). The mounting rail 42 may be configured to connect to a plurality of devices (e.g., mandible, earpieces, camera, light, oxygen mask, etc.). The helmet attachment 24 may be shaped to be positioned adjacent the mounting rail 42. The helmet attachment 24 may be shaped and dimensioned to follow the contours of the mounting rail 42. The lower rim 32 of the helmet attachment 24 may be positioned below an upper rim of a mounting rail 42. The helmet attachment 24 may include a rear rim 44 and a first edge 46 (FIG. 3). The first edge 46 may be transverse to the rear rim 44. The first edge 46 may extend upwardly from the rear rim 44 toward a central axis $A_2$. The first edge 46 may be at an angle θ of about 55 degrees to about 85 degrees, about 45 degrees to about 65 degrees, or about 60 degrees to about 90 degrees relative to the rear rim 44. The helmet attachment 24 may include a second edge 48. The second edge 48 may extend from an end of the first edge 46 away from axis 40. The first edge 46 and the second edge 48 may be shaped to follow the contour of the rail 42. The helmet attachment 24 may include a mounting rail 42 and the helmet attachment 24 may be shaped to cover the entire outer surface of the helmet 22.

Referring to FIG. 3, in some embodiments, the helmet attachment 24 may include a first piece 52 and a second piece 54. The first piece 52 and second piece 54 may be coupled or removed from the helmet 22 independently of one another. The first piece 52 and the second piece 54 may be coupled to each other. In some embodiments, the first piece 52 is a front piece configured to protect a front portion of the helmet 22 and the second piece 54 is a rear piece configured to protect a rear portion of the helmet 22. In other embodiments, the first piece 52 is a left side piece and the second piece 54 is a right side piece. In some embodiments, the first piece 52 and the second piece 54 cover the same percentage of the surface area of the helmet 22. In other embodiments, one of the first piece 52 and the second piece 54 covers more of the surface area of the helmet 22 than the other of the first piece 52 and the second piece 54.

A helmet attachment 24 that includes more than one piece may allow for easier attachment or detachment of the helmet attachment 24 from the helmet 22. A helmet attachment 24 that includes more than one piece may allow a force to be applied to each piece in a relatively perpendicular direction which may reduce or minimize the force necessary to decouple each piece of the helmet attachment 24 from the helmet 22.

Still referring to FIG. 3, there may be a space 53 between the first piece 52 and the second piece 54. The space 53 may have a thickness of about 0.25 inches to about 3 inches. The first piece 52 may be directly adjacent the second piece 54. The first piece 52 may be in contact with the second piece 54. At least one of the first piece 52 and the second piece 54 may be coupled to the helmet 22 in a variety of orientations or positions such that the shape or thickness of the space 53 depends on the position of the first piece 52 and the second piece 54. In some embodiments, the helmet attachment 24 may include more than two pieces. The first piece 52 may be manufactured from a first material and the second piece 54 may be manufactured from a second material. The first material may be different from the second material. The first piece 52 may have a different thickness than the second piece 54. In some embodiments, the first piece 52 is thicker than the second piece 54. In some embodiments, the second piece 54 is thicker than the first piece 52. One of the first piece 52 and the second piece 54 may provide greater ballistic or impact resistance than the other of the first piece 52 and the second piece 54.

Figure 6:
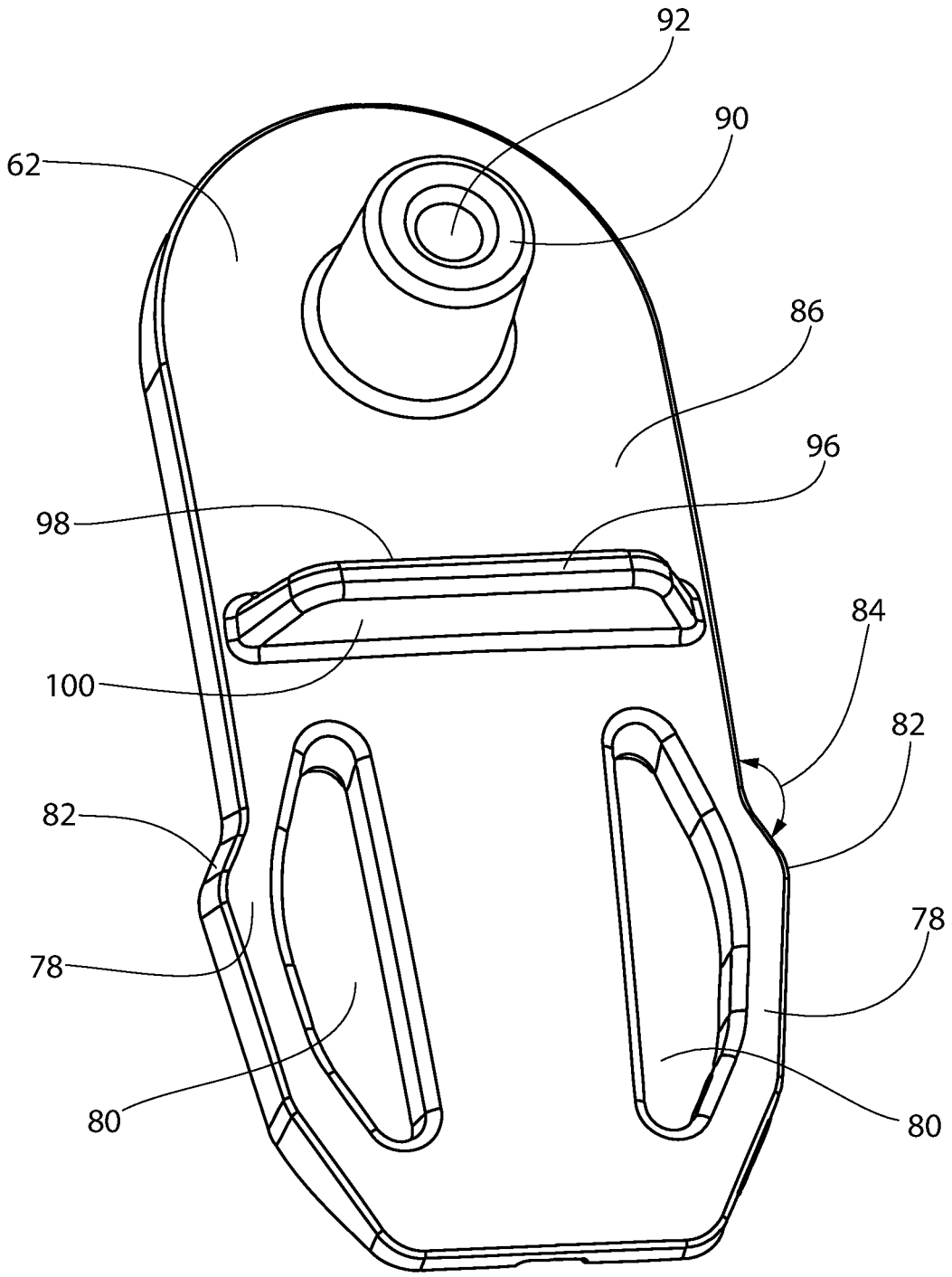
FIG. 6 is a front elevational view of the fastener of FIG. 1.
Figure 7:
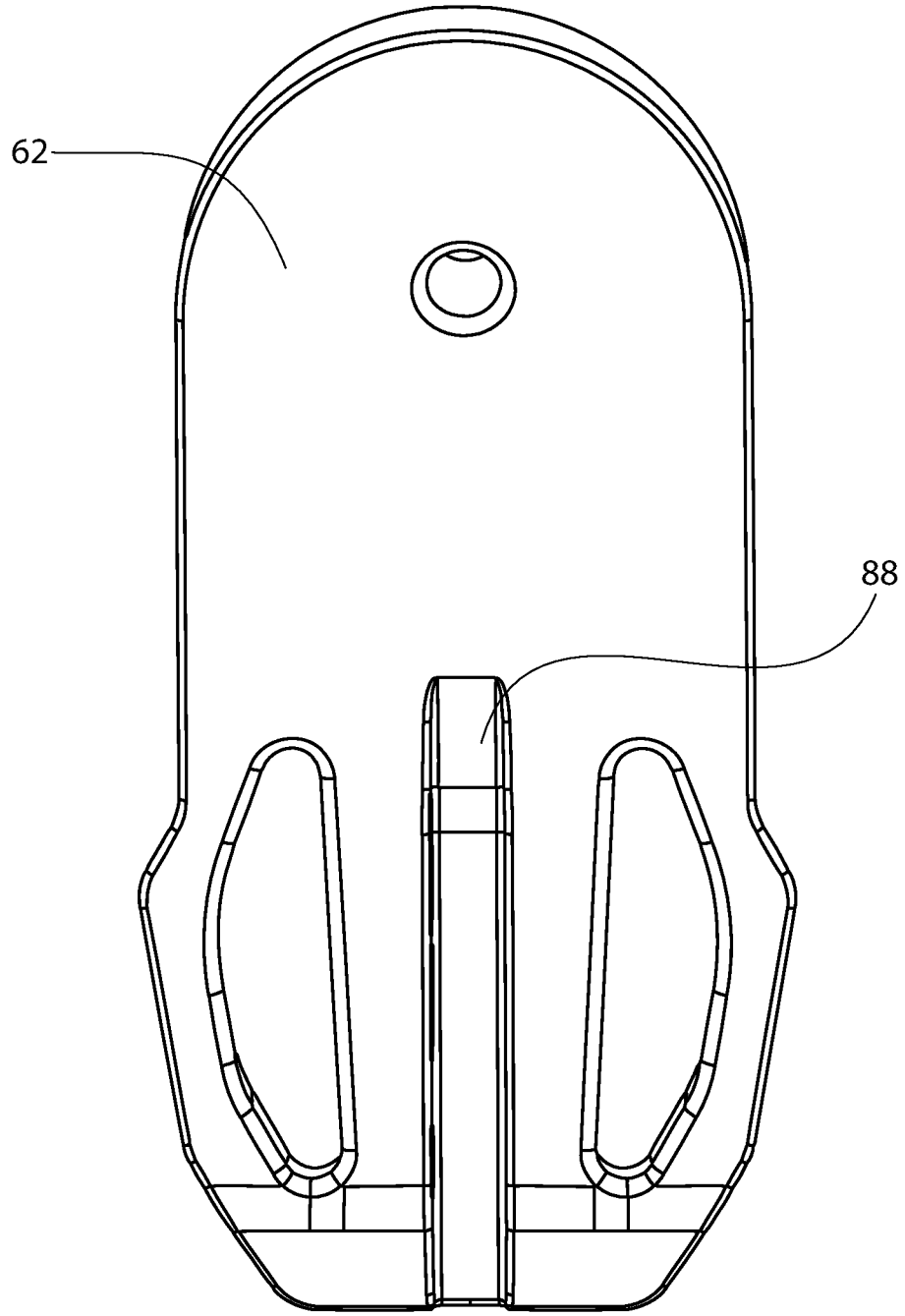
FIG. 7 is a rear elevational view of the fastener of FIG. 1.
Figure 8:
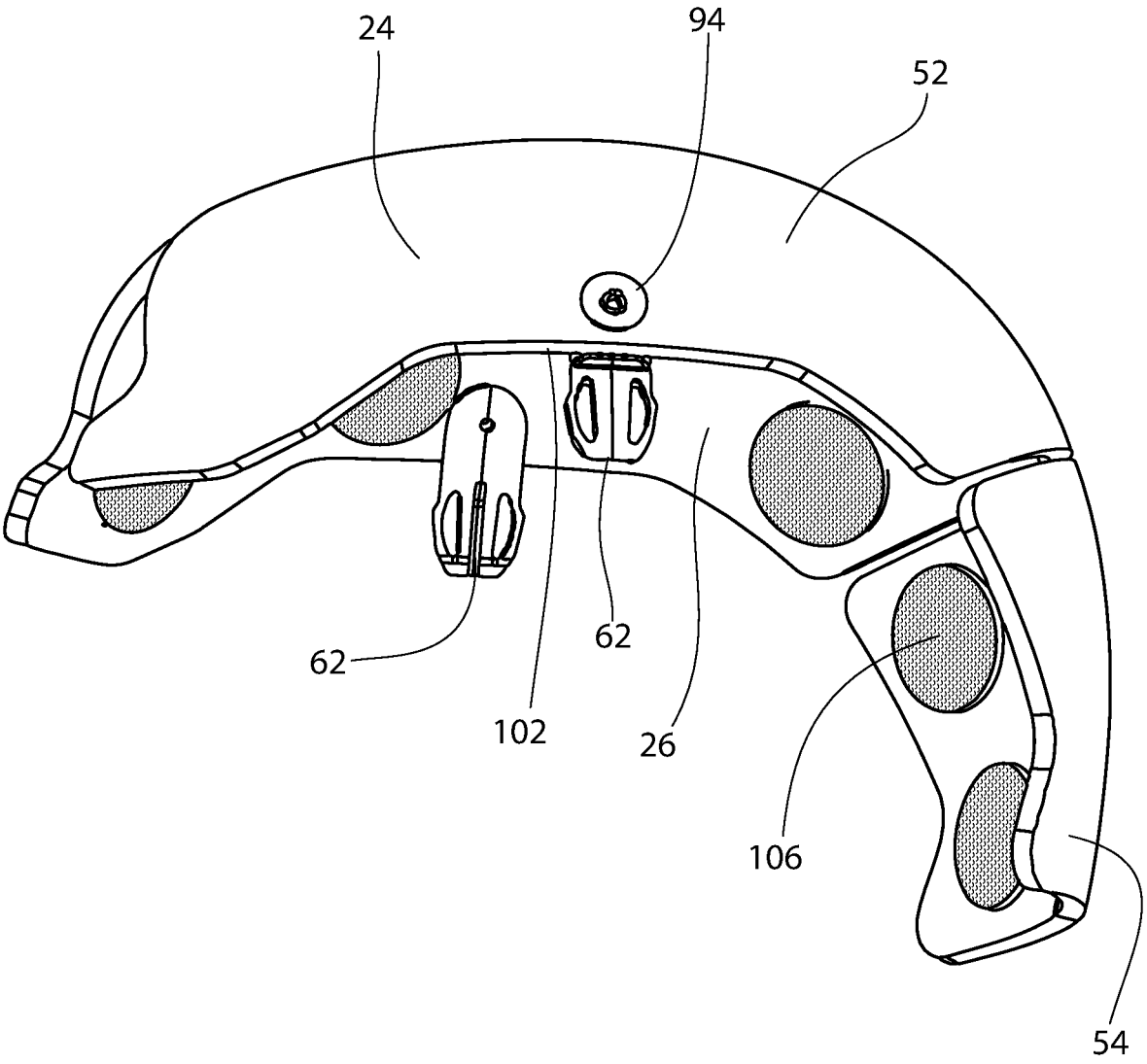
FIG. 8 is a left-side elevational view of the helmet attachment of FIG. 1.

Referring to FIGS. 6-8, it may be desirable to have a helmet attachment 24 that can be detachably secured to the helmet 22 such that the helmet attachment 24 can be removed when desired. A hook and loop fastener may detachably couple the helmet attachment 24 to the helmet 22. Hook and loop fasteners may provide a strong attachment force in a direction generally tangent to the helmet attachment. Hook and loop fasteners may become decoupled if a strong enough force is applied (e.g., impact from a ballistic projectile). A fastener 62 may be used to prevent the helmet attachment 24 from unintentionally detaching from the helmet 22. The fastener 62 may help to align the helmet attachment 24 on the helmet 22 which may assist a user in attaching and properly aligning the helmet attachment 24 on the helmet 22 when the user cannot visually observe the placement of the helmet attachment (e.g., when the user is wearing the helmet 22 and attaching the helmet attachment 24). Hook and loop fasteners may prevent relative movement between the helmet attachment 24 and the helmet 22 which may prevent the helmet attachment from sliding into position once the hook and loop fasteners are engaged. The fastener 62 may engage with a fastener 64 on the helmet 22 before the hook and loop fasteners engage to ensure proper alignment of the helmet attachment 24 on the helmet 22.

Figure 5:
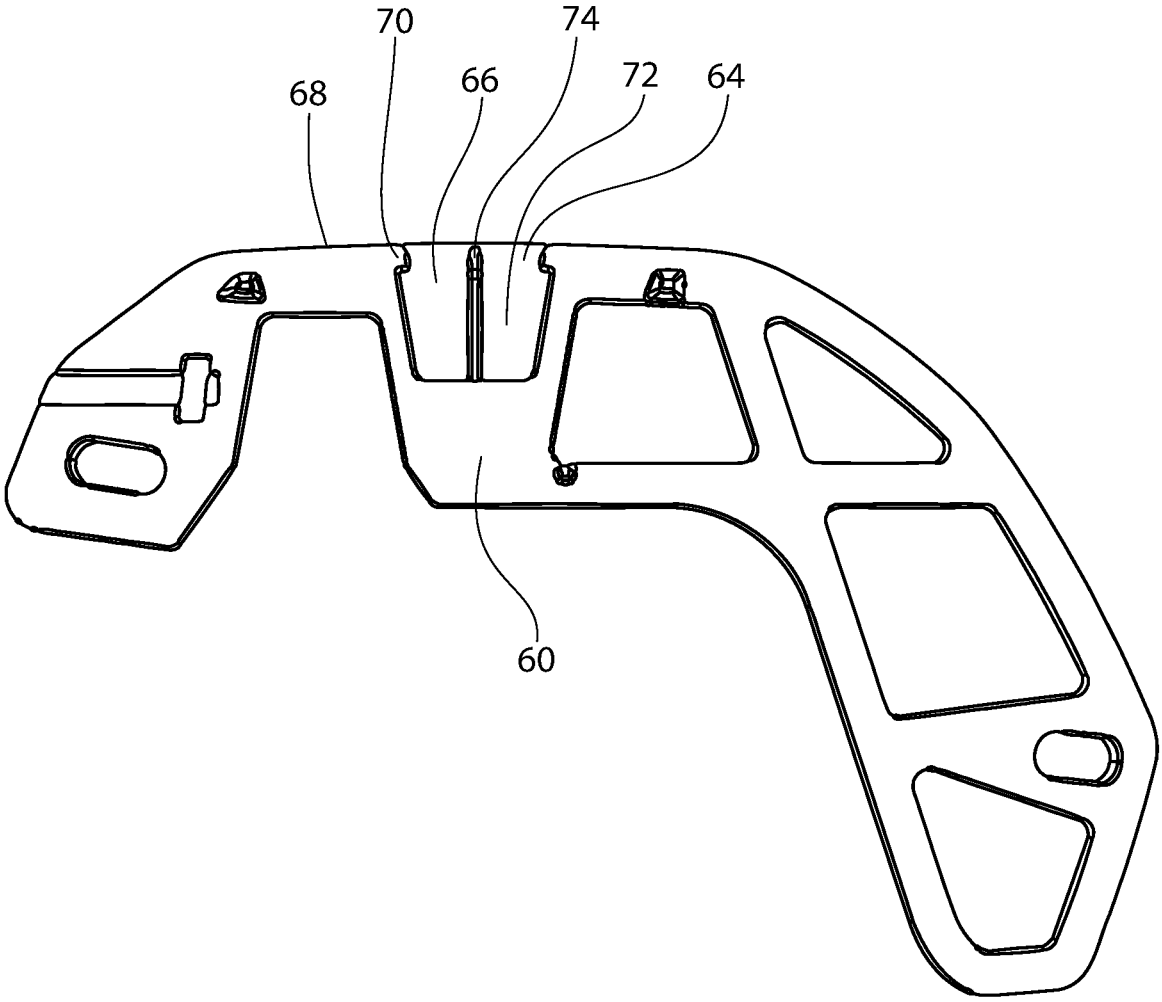
FIG. 5 is a left-side elevational view of the spacer of FIG. 1.
Figure 9:
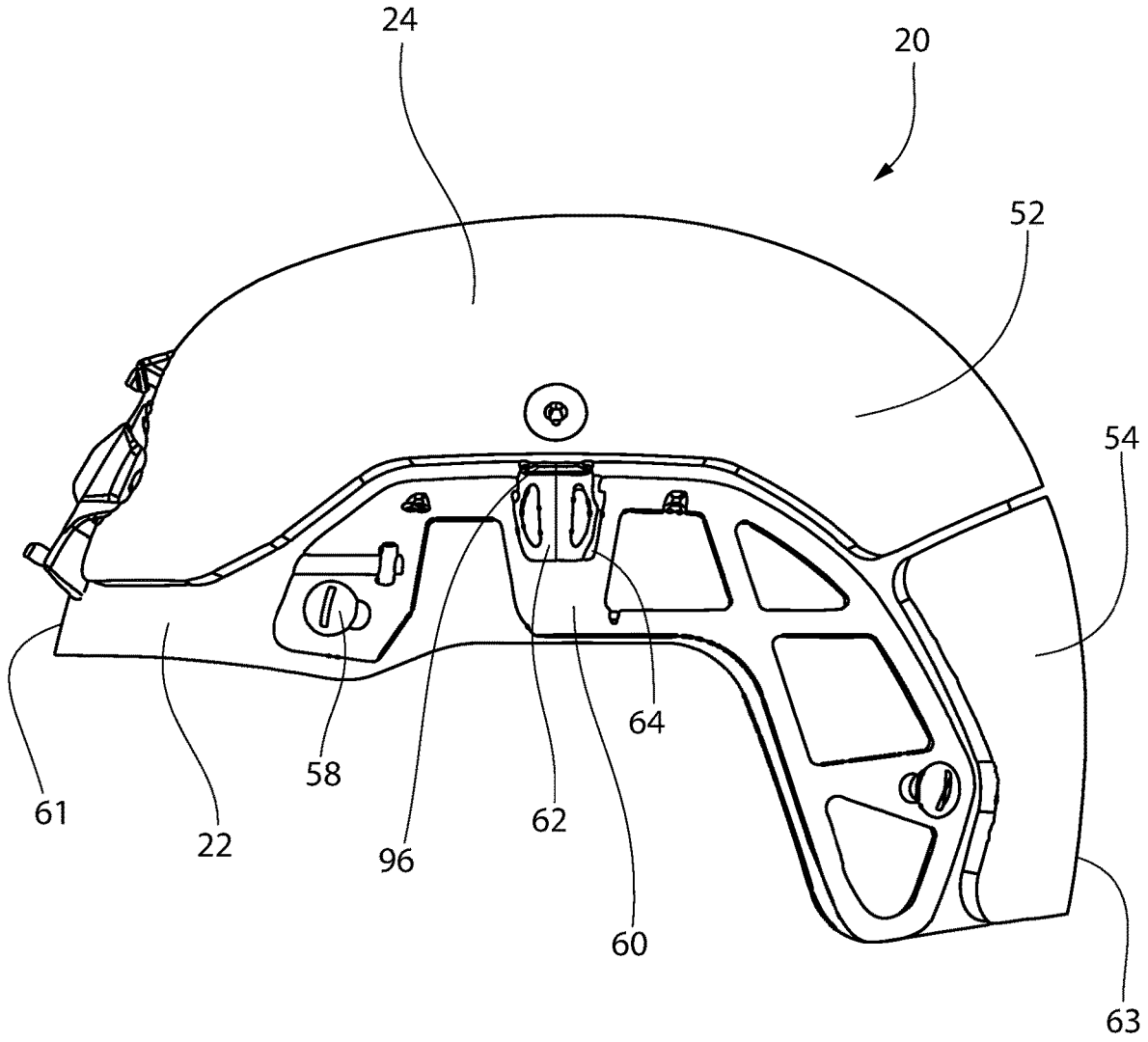
FIG. 9 is a left-side view of the helmet system of FIG. 1 with the mounting rail removed.

Referring to FIGS. 4-5, the mounting rail 42 may be coupled to an outer surface 56 of the helmet 22 by one or more fasteners 58 (e.g., screw, nut and bolt, adhesive, or weld). In one embodiment, each mounting rail 42 is coupled to the helmet by two fasteners 58 that extend through the pre-existing through holes of the helmet used to couple the straps of the retention system (not shown) to the helmet. In some embodiments, the mounting rail 42 is coupled directly to the helmet 22. In other embodiments, a spacer 60 is positioned between the helmet 22 and mounting rail 42. The mounting rail 42 may be configured to be detachably coupled to a fastener 62 (FIG. 6) on the helmet attachment 24. In one embodiment, the fastener 62 is a clip that extends downwardly from an edge as discussed further below. The mounting rail 42 may include a corresponding fastener 64 configured to receive the fastener 62. In one embodiment, the corresponding fastener 64 is a fastener receiver. The fastener 64 may be a recess or a space between a rear surface of the mounting rail 42 and the helmet 22 such that the fastener 62 can be positioned in the fastener 64 between the mounting rail 42 and the outer surface 56 of the helmet 22. The fastener 64 may be positioned above a user's ear when the user is wearing the helmet system 20. The fastener 62 may be positioned about halfway between a front 61 and a rear 63 of the helmet system (FIG. 9). The fastener 64 may be adjacent an upper surface of the mounting rail 42.

The mounting rail 42 may include more than one fastener 64. The mounting rail 42 may include two fasteners 64, one to receive a fastener 62 coupled to the first piece 52 and one to receive a fastener 62 coupled to the second piece 54. Each of the first piece 52 and the second piece 54 may include a fastener 62 that engages a fastener 64 on the helmet 22. The first piece 52 and the second piece 54 may include one or more fasteners that couple the first piece 52 and the second piece 54 to each other. The helmet 22 may include two mounting rails 42 and the helmet attachment 24 may be coupled to both mounting rails. The helmet attachment 24 may extend across a top surface of the helmet 22 when the helmet attachment 24 is coupled to both mounting rails 42. In one embodiment, a kit includes spacer 60, first piece 52, and second piece 54.

Still referring to FIGS. 4-5, the fastener 64 may be defined by both the mounting rail 42 and the spacer 60. The front of the fastener 64 may be defined by the mounting rail 42 and the rear of the fastener 64 may be defined by the spacer 60. The spacer 60 may include a receiver opening 66 at an upper edge 68 of the spacer 60 such that the fastener 62 can be inserted into the fastener 64 through the top of the spacer 60. The spacer 60 may include a ledge 70 between the receiver opening 66 and the main portion 72 of the fastener 64. The ledge 70 may prevent the fastener 62 from exiting the fastener 64, as explained in greater detail below. The spacer 60 may include a protrusion 74 in the fastener 64 configured to engage the fastener 62. The spacer 60 may include openings such that the fastener 58 (FIG. 4) may couple the mounting rail 42 and the spacer 60 to the helmet 22. In some embodiments, the mounting rail 42 and the spacer 60 are separate elements. In other embodiments, the mounting rail 42 and spacer 60 are a unitary construct.

Still referring to FIGS. 4-5, the fastener 62 may detachably couple the helmet attachment 24 to the helmet 22. The fastener 62 may stabilize the helmet attachment 24 on the helmet 22. The fastener 62 may provide additional attachment force to couple the helmet attachment 24 to the helmet 22. The fastener 62 may help position the helmet attachment 24 on the helmet 22. The fastener 62 may be generally rigid such that the fastener 62 guides the helmet attachment 24 into position relative to the helmet 22 once the fastener engages fastener 64.

Referring to FIGS. 6-9, the fastener 62 may include a sidewall 78 configured to move between a contracted position and a relaxed position. The fastener 62 may include reliefs 80 such that a user may apply an inward force to the sidewall 78 such that the sidewall 78 moves from the relaxed position to the contracted position. The fastener 62 may be manufactured from a resilient material such that the sidewall 78 returns to the relaxed position when the inward force is no longer applied to the sidewall 78. The sidewall 78 may move from the relaxed position to the contracted position as the fastener 62 is inserted into the fastener 64 through the receiver opening 66 and the sidewalls 78 engage the ledge 70. The sidewall 78 may return to the relaxed position after the sidewall 78 clears the ledge 70. The fastener 62 may include a catch 82 configured to engage a portion of the receiver (e.g., the ledge 70) when the fastener is in the fastener 64 to prevent removal of the fastener 62. An angle 84 between a body 86 of the fastener 62 and the catch 82 may be selected to achieve a desired pullout force required to remove the fastener 62 from the fastener 64. A smaller angle 84 (e.g., closer to 0 degrees) may require less force to remove the fastener 62 from the fastener 64 than a larger angle (e.g., closer to 90 degrees). In some embodiments, the fastener 62 is removably received by the fastener 64 as shown in FIG. 8 (the mounting rail 42 is not shown in FIG. 8 for ease of illustration). In other embodiments, the fastener 62 is fixed to the helmet system 20 when the fastener 62 is in the fastener 64 and may not be removed.

Referring to FIG. 7, the fastener 62 may include a channel 88 configured to receive the protrusion 74 of the fastener 64. The channel 88 and protrusion 74 may be configured to align the fastener 62 as it is inserted into the fastener 64. The protrusion 74 within the channel 88 may resist rotation of the fastener 62 within the fastener 64.

Referring to FIG. 6, the fastener 62 may include a shaft 90 protruding from the body 86. The shaft 90 may be configured to be received by an opening 91 (FIG. 2) in the helmet attachment 24. The shaft 90 may include a bore 92 configured to receive a connector 94 (e.g., rivet, screw) to couple the fastener 62 to the helmet attachment 24 as shown in FIG. 8.

Referring to FIGS. 6 and 8, the fastener 62 may include a tab 96 protruding from the body 86. The tab 96 may protrude away from the body 86 by a distance that is less than the distance the shaft 90 protrudes from the body 86. The tab 96 may include an upper surface 98 and a lower surface 100. The upper surface 98 of the tab 96 may be adjacent a lower surface 102 of the helmet attachment 24 when the fastener 62 is coupled to the helmet attachment 24. The tab 96 may prevent relative rotation between the fastener 62 and the helmet attachment 24 when the upper surface 98 of the tab 96 engages the lower surface 102 of the helmet attachment 24. The lower surface 100 of tab 96 may be adjacent the upper edge 68 of the spacer 60 or mounting rail 42 when the fastener 62 is within the fastener 64 (FIG. 9). The fastener 62 may couple one of the first piece 52 and the second piece 54 to the helmet 22. The other of the first piece 52 and the second piece 54 may include another fastener 62 configured to be received by another fastener 64. One mounting rail 42 may include more than one fastener 64 to receive more than one fastener 62.

Referring to FIG. 4, the first connector 104 (e.g., magnet, hook and loop fastener, adhesive, or a combination thereof) may be coupled to the outer surface 56 of the helmet 22. The first connector 104 may be configured to couple to a second connector 106 on the inner surface of the helmet attachment 24 (FIG. 8) to couple the helmet attachment 24 to the helmet 22. The first connector 104 may cover about 5%, about 10%, about 20%, about 30%, about 40%, about 50%, about 60%, about 70%, about 80%, about 90%, or about 100% of the outer surface 56 of the helmet 22. The helmet 22 may include a plurality of first connectors 104, at least one of the plurality of first connectors 104 having a different shape than another of the plurality of first connectors 104. The size or number of first connectors 104 may be selected to achieve a desired attachment strength. In some embodiments, the helmet 22 includes a plurality of first connectors 104 which are hook and loop patches. In other embodiments, the first connector 104 and the second connector 106 are at least one of magnets, hook and loop fasteners, or a combination thereof. The helmet 22 may include the loops and the helmet attachment 24 may have the hooks. In some embodiments, the first connector 104 and second connector 106 are magnets that align the helmet attachment 24 as it is brought into proximity with the helmet 22. The helmet 22 may include a plurality of first connectors 104 one or more of which may have a different shape than another of the plurality of first connectors 104. In some embodiments, the helmet attachment 24 includes the first portion 52 and the second portion 54 and the second portion 54 is detachable while at least one of the fasteners 62 are in the fastener 64. In some embodiments, the fastener 62 may be positioned within the fastener 64 before the first connector 104 engages the second connector 106. In other embodiments, the first connector 104 may engage the second connector 106 before the fastener 62 is coupled to the fastener 64. The helmet attachment 24 may be detached from the helmet 22 by applying a force generally perpendicular to the helmet attachment 24, thereby disengaging the fastener 62 from the fastener 64 and the first connector 104 from the second connector 106. In some embodiments, a user may apply a force to the sidewall 78 of the fastener 62 to remove the fastener 62 from fastener 64. In other embodiments, one of fastener 62 and fastener 64 include a release that can be actuated to disengage fastener 62 from fastener 64.

Referring to FIG. 10, there may be a space 107 between the helmet 22 and the helmet attachment 24 when the helmet attachment 24 is coupled to the helmet 22. The space 107 may have a space thickness that is thicker than at least one of the helmet attachment thickness $T_1$ or the helmet thickness $T_2$. The thickness of the space 107 may be influenced by the thickness of the first connector 104 or the second connector 106. One of the first connector 104 and the second connector 106 may include a resilient material that absorbs an impact applied to the helmet attachment 24.

A kit may include the helmet accessory 24, the spacer 60, and the fastener 62. A method of coupling the helmet accessory 24 to the helmet 22 may include obtaining a helmet 22 having a mounting rail 42. The method may include removing the existing mounting rail 42 and positioning the spacer 60 between the helmet 22 and the mounting rail 42. The mounting rail 42 and the spacer 60 may be coupled to the helmet 22 by placing fasteners 58 in pre-existing holes in the helmet 22. The method may include moving the fastener 62 of the helmet accessory 24 into engagement with the fastener 64 of the mounting rail 42 or spacer 60. The method may include moving the helmet accessory 24 toward the surface of the helmet 22 such that a first connector 104 on the helmet 22 engages a second connector 106 on an inner surface of the helmet accessory 24.

It will be appreciated by those skilled in the art that changes could be made to the exemplary embodiments shown and described above without departing from the broad inventive concepts thereof. It is understood, therefore, that this invention is not limited to the exemplary embodiments shown and described, but it is intended to cover modifications within the spirit and scope of the present invention as defined by the claims. For example, specific features of the exemplary embodiments may or may not be part of the claimed invention and various features of the disclosed embodiments may be combined. The words "right", "left", "lower" and "upper" designate directions in the drawings to which reference is made. The words "inwardly" and "outwardly" refer to directions toward and away from, respectively, the geometric center of the helmet system 20. Unless specifically set forth herein, the terms "a", "an" and "the" are not limited to one element but instead should be read as meaning "at least one".

It is to be understood that at least some of the figures and descriptions of the invention have been simplified to focus on elements that are relevant for a clear understanding of the invention, while eliminating, for purposes of clarity, other elements that those of ordinary skill in the art will appreciate may also comprise a portion of the invention. However, because such elements are well known in the art, and because they do not necessarily facilitate a better understanding of the invention, a description of such elements is not provided herein.

Further, to the extent that the methods of the present invention do not rely on the particular order of steps set forth herein, the particular order of the steps should not be construed as limitation on the claims. Any claims directed to the methods of the present invention should not be limited to the performance of their steps in the order written, and one skilled in the art can readily appreciate that the steps may be varied and still remain within the spirit and scope of the present invention.

I claim:

1. A helmet attachment comprising:

a body having a concave inner surface configured to engage a convex outer surface of a helmet, the body including a rim;

a connector coupled to the concave inner surface of the body, the connector configured to engage a helmet connector; and a fastener extending from the rim and configured to engage a fastening element coupled to the helmet, wherein the fastening element is coupled to the convex outer surface of the helmet, and wherein the fastening element is a mounting rail.

2. The helmet attachment of claim 1, wherein the helmet attachment includes a first portion and a second portion and each of the first portion and the second portion are independently detachable from the helmet.

3. The helmet attachment of claim 2, wherein the first portion comprises a front portion and the second portion comprises a rear portion.

4. The helmet attachment of claim 1, wherein the body includes a cutout configured to receive a shroud coupled to the helmet.

5. The helmet attachment of claim 4, wherein the cutout comprises a spade shape.

6. The helmet attachment of claim 1, wherein the helmet attachment is rigid.

7. The helmet attachment of claim 1, wherein the connector includes a plurality of connector patches, each of the plurality of connector patches comprising one half of a hook and loop connector.

8. The helmet attachment of claim 1, wherein the fastener is rigid.

9. The helmet attachment of claim 1, wherein the fastener includes a sidewall having a catch configured to engage the fastening element.

10. The helmet attachment of claim 9, wherein the sidewall is bendable to selectively disengage the catch from the fastening element.

11. The helmet attachment of claim 1, wherein the body comprises at least one of polystyrene, polypropylene, urethane, aromatic polyamide fiber, polyethylene, acrylonitrile butadiene styrene, nylon, and ceramic.

12. The helmet attachment of claim 1, wherein an infrared visibility of an outer surface of the body is generally constant throughout.

13. The helmet attachment of claim 1, wherein the body includes an opening and the fastener includes a shaft configured to be received by the opening.

14. A helmet system comprising:

a helmet having an outer surface;

a mounting rail coupled to the helmet;

a spacer positioned between the helmet and the mounting rail; and an impact protection attachment removably coupled to the helmet and at least partially extending over the outer surface of the helmet, the impact protection attachment including a fastener configured to be coupled to the mounting rail, wherein the mounting rail includes a receiver and the fastener is configured to be received by the receiver, and wherein the fastener is configured to be positioned between the spacer and the mounting rail.

15. The helmet system of claim 14, wherein the mounting rail is integrally formed with the spacer.

16. The helmet system of claim 15, wherein the fastener includes a sidewall having a catch configured to engage a portion of the receiver.

17. The helmet system of claim 14, wherein the impact protection attachment is detachably coupled to the helmet.

18. The helmet system of claim 14, wherein the impact protection attachment comprises at least one of polystyrene, polypropylene, urethane, aromatic polyamide fiber, acrylonitrile butadiene styrene, nylon, polyethylene, and ceramic.

19. The helmet system of claim 14, wherein the impact protection attachment includes a first portion and a second portion and each of the first portion and the second portion are independently detachable from the helmet.

20. The helmet system of claim 14 further comprising:

a connector between the helmet and the impact protection attachment.

21. A helmet attachment comprising:

a body having a concave inner surface configured to engage a convex outer surface of a helmet, the body including a rim;

a connector coupled to the concave inner surface of the body, the connector configured to engage a helmet connector; and a fastener extending from the rim and configured to engage a fastening element coupled to the helmet, wherein the body includes an opening and the fastener includes a shaft configured to be received by the opening.

* * * * *